US006189596B1

(12) United States Patent
Chen

(10) Patent No.: US 6,189,596 B1
(45) Date of Patent: Feb. 20, 2001

(54) STRUCTURE OF A DRIVING MECHANISM FOR VENETIAN BLINDS

(76) Inventor: Dong-Rong Chen, P.O. Box 82-144, Taipei (TW)

( * ) Notice: Under 35 U.S.C. 154(b), the term of this patent shall be extended for 0 days.

(21) Appl. No.: 09/409,226

(22) Filed: Sep. 30, 1999

(51) Int. Cl.[7] ..... E06B 9/30
(52) U.S. Cl. ..... 160/176.1 R
(58) Field of Search ..... 160/168.1 R, 173 R, 160/176.1 R, 177 R, 172 R, 170 R, 171 R

(56) References Cited

U.S. PATENT DOCUMENTS 3,276,511 * 10/1966 Armenia et al. ..... 160/168.1 R
5,472,035 * 12/1995 Baba et al. ..... 160/168.1 R
5,538,066 * 7/1996 Liu ..... 160/173 R
5,553,653 * 9/1996 Rozon ..... 160/173 R

* cited by examiner

*Primary Examiner*—David M. Purol
(74) *Attorney, Agent, or Firm*—A & J

(57) ABSTRACT

The present invention relates to an improved structure of a driving mechanism for a venetian blind, wherein the frame body is provided with fixing seats having being mounted with blind slat control element. The control element is driven by a control shaft and a pulling cord is connected to the blind slats. A suspension cord passes through individual blind slat and combines with the base slat at the bottom of the blind slat such that the suspension cord can pull the base slat to close or open the individual blind slat.

1 Claim, 6 Drawing Sheets

STRUCTURE OF A DRIVING MECHANISM FOR VENETIAN BLINDS

BACKGROUND OF INVENTION a) Technical Field of the Invention

The present invention relates to an improved structure of a driving mechanism for venetian blinds, and in particular, a driving mechanism employing a reinforcement section mounted at the two lateral walls of a fixing seat, and in combination with a lateral wall cord-fixing hole and a blocking section, and a positioning section on a slat control element to ensure that slat control element is positioned at the two lateral walls of the fixing seat.

b) Description of the Prior Art

There are numerous types of driving mechanism for Venetian blinds available in the market. For example, as shown in FIGS. 6 and 7, a driving mechanism having a frame body 10 is provided with two groups of fixing seat 20, and the center of the top section of the two lateral wall 21 is pivotally mounted with a blind slat control element 30 driven by a control shaft 40. A pulling cord 50 is mounted at the top of the blind slat control element 30 and is used to pull up main cords 51 located at the two sides of the pulling cord 50. The two main cords 51 respectively pass through the pulling cord hole 220 at the bottom section of the fixing seat 20, and in combination with the suspension cord 60, via the suspension cord hole 221 located at the bottom section 22 of the fixing seat 20 to control the up and down movement and angle of variation of the blind slats 70. A clipping cord 52 is provided in between the two main cords 51 for the mounting of the blind slats 70.

A hole 71 is provided to the blind slat 70 to allow the passage of the suspension cord 60. The bottom of the blind slat 70 is provided with a base blind 80 to combine with the suspension cord 60 and the end of the pulling cord 50 as a unit. However, this structure has the following drawbacks:

(a) As the blind slat control slats 70 and the fixing seat 20 often cause friction, and the control shaft 40 is made from metal material while the fixing seat 20 made of plastic material, the rotating of the control shaft 40 being provided with polygonal control shaft 40 will damage the positioning slot 212 and the stopping block 217. Thus, the stopping block 217 does not provide an effective function.

(b) In the conventional fixing seat 20, an engaging block 218 is provided to one end of the two lateral walls 21. Thus, only one end of the engagement can be used and the stability of the fixing seat is limited.

(c) The top section of the lateral walls 21 of the fixing seat 20 is exerted by force. The reinforcement structure at the bottom of the lateral walls 21 used to support the pressure of the control element 30 and the control shaft 40 is not sufficient. Thus, the fixing seat 20 may be deformed.

(d) The pulling of the base slat 80 and blind slats 70 by the suspension cord 60 is not smooth. Due to the direct pulling of the structure, the user requires a stronger force to offset the total weight of the slats 70 and the base slat 80. Thus, it is not convenient for the weaker user or children to operate the venetian blinds.

SUMMARY OF THE INVENTION

Accordingly, it is an object of the present invention to provide an improved structure of a driving mechanism for venetian blinds, and in particular, a driving mechanism employing a reinforcement section mounted at the two lateral walls of a fixing seat, and in combination with a lateral wall cord-fixing hole and a blocking section, and a positioning section on a blind slat control element to ensure that the slat control element is positioned at the two lateral walls of the fixing seat.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE INVENTION

Figure 1:
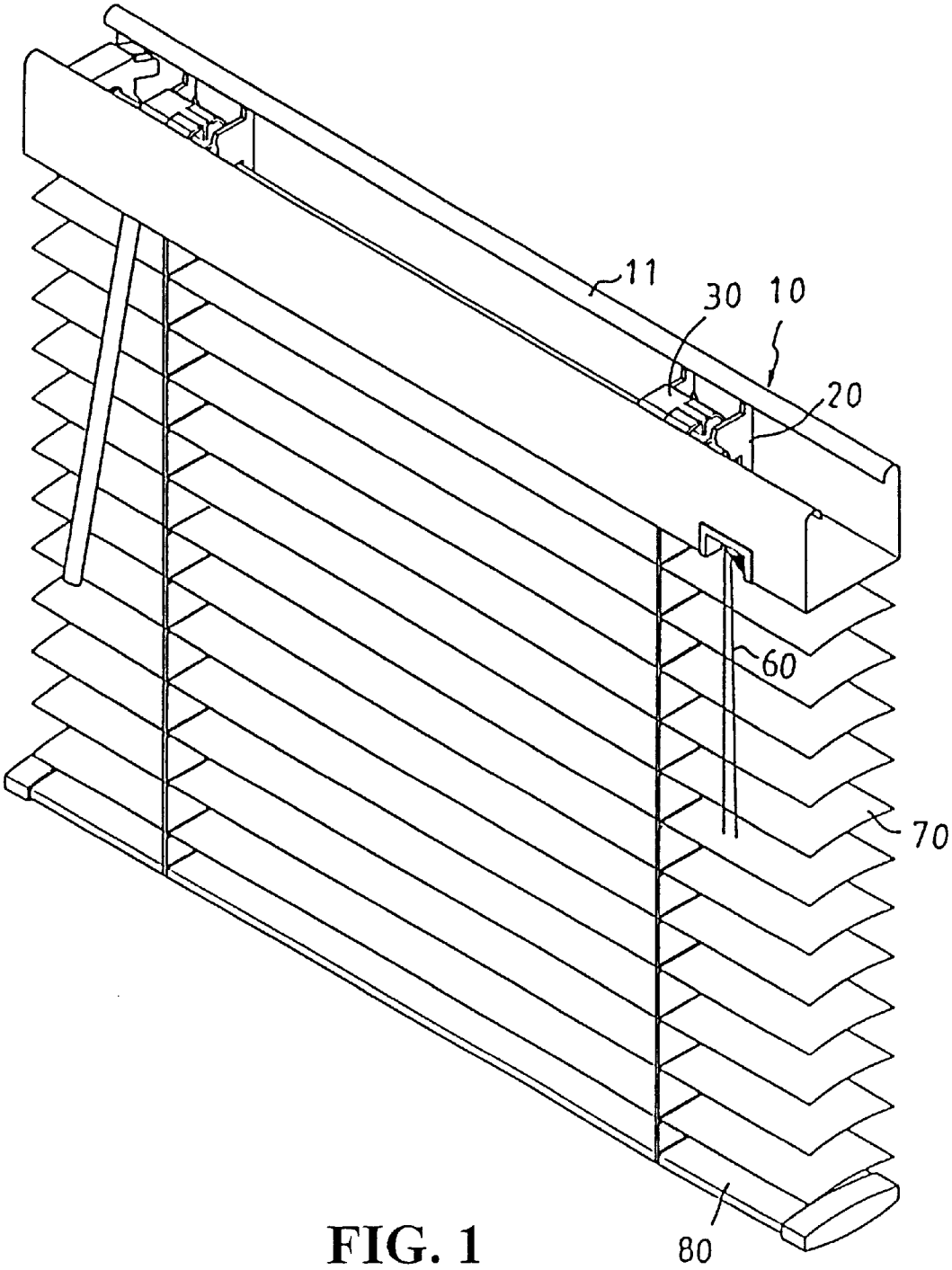
FIG. 1 is a perspective schematic view of the entire structure of the venetian blinds of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
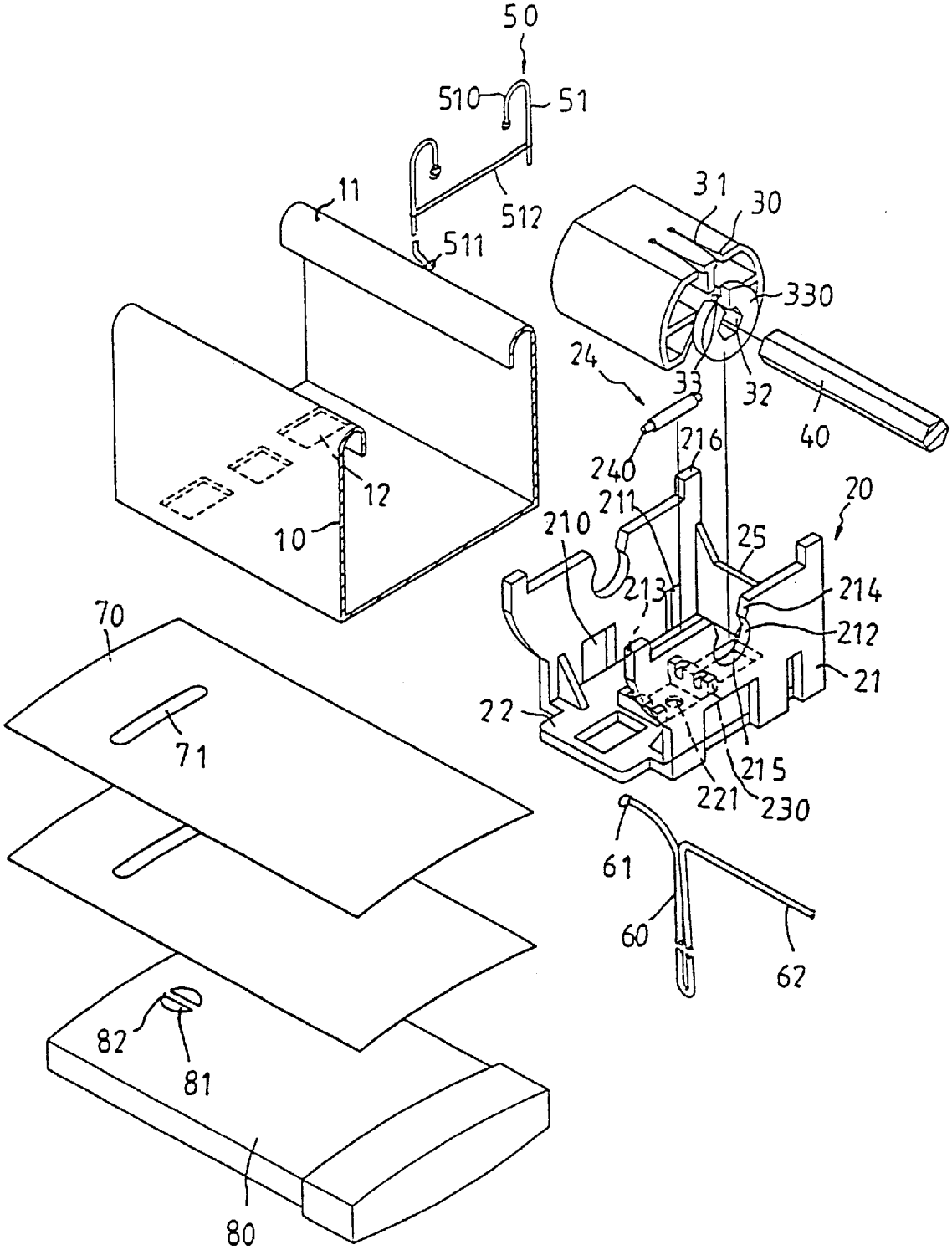
FIG. 2 is a perspective exploded view of the fixing seat and the blind slat control element of the venetian blinds of the present invention.
Figure 3:
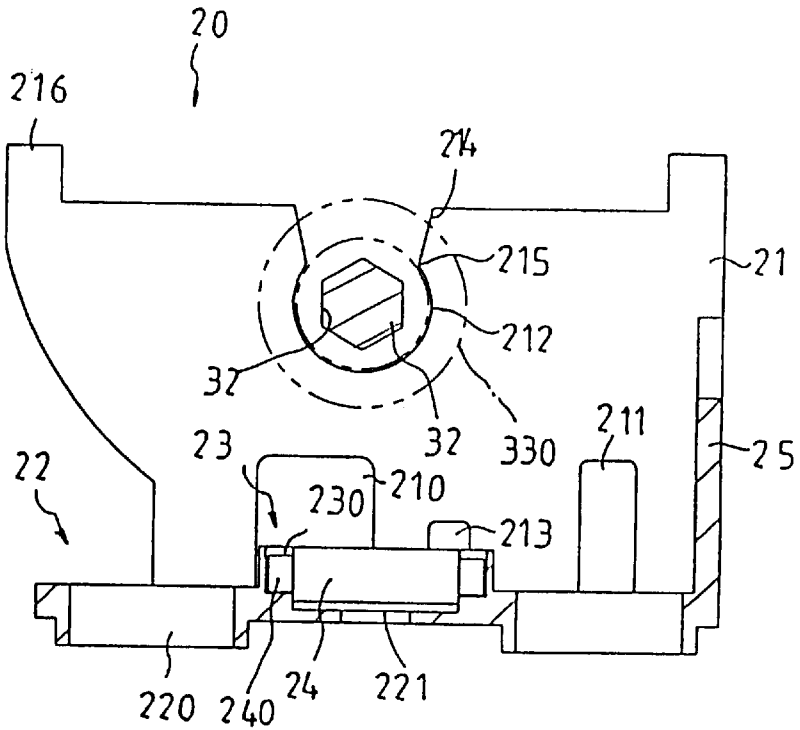
FIG. 3 is a sectional view of the fixing seat of the venetian blinds of the present invention.
Figure 4:
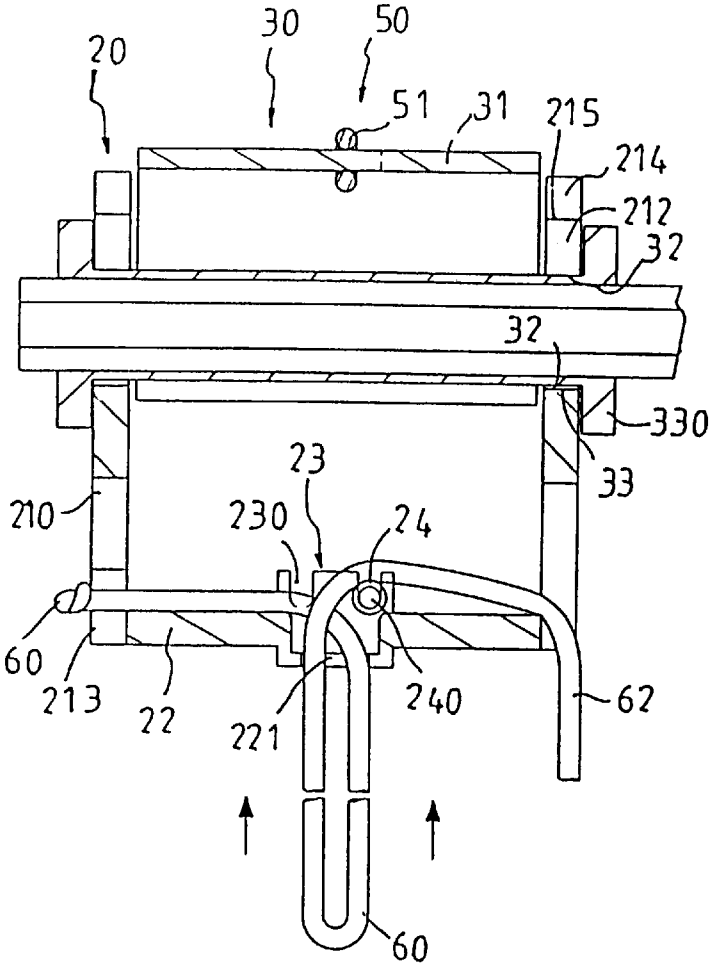
FIG. 4 is a sectional view of the combination of the fixing seat, the blind slat control element, and the pulling cord of the venetian blinds of the present invention.
Figure 5:
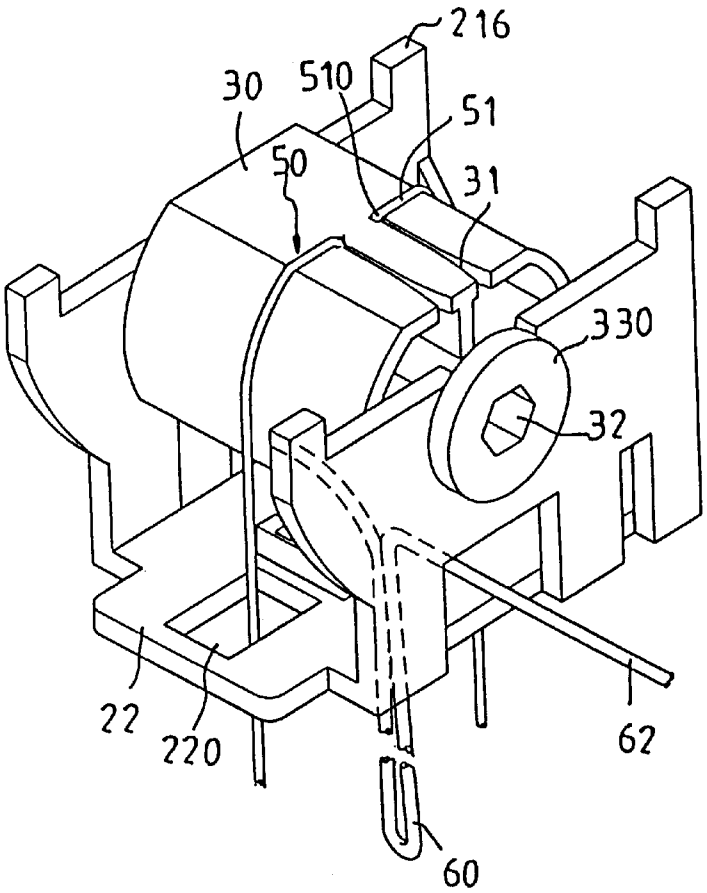
FIG. 5 is a perspective view of the driving mechanism of the venetian blinds of the present invention.
Figure 6:
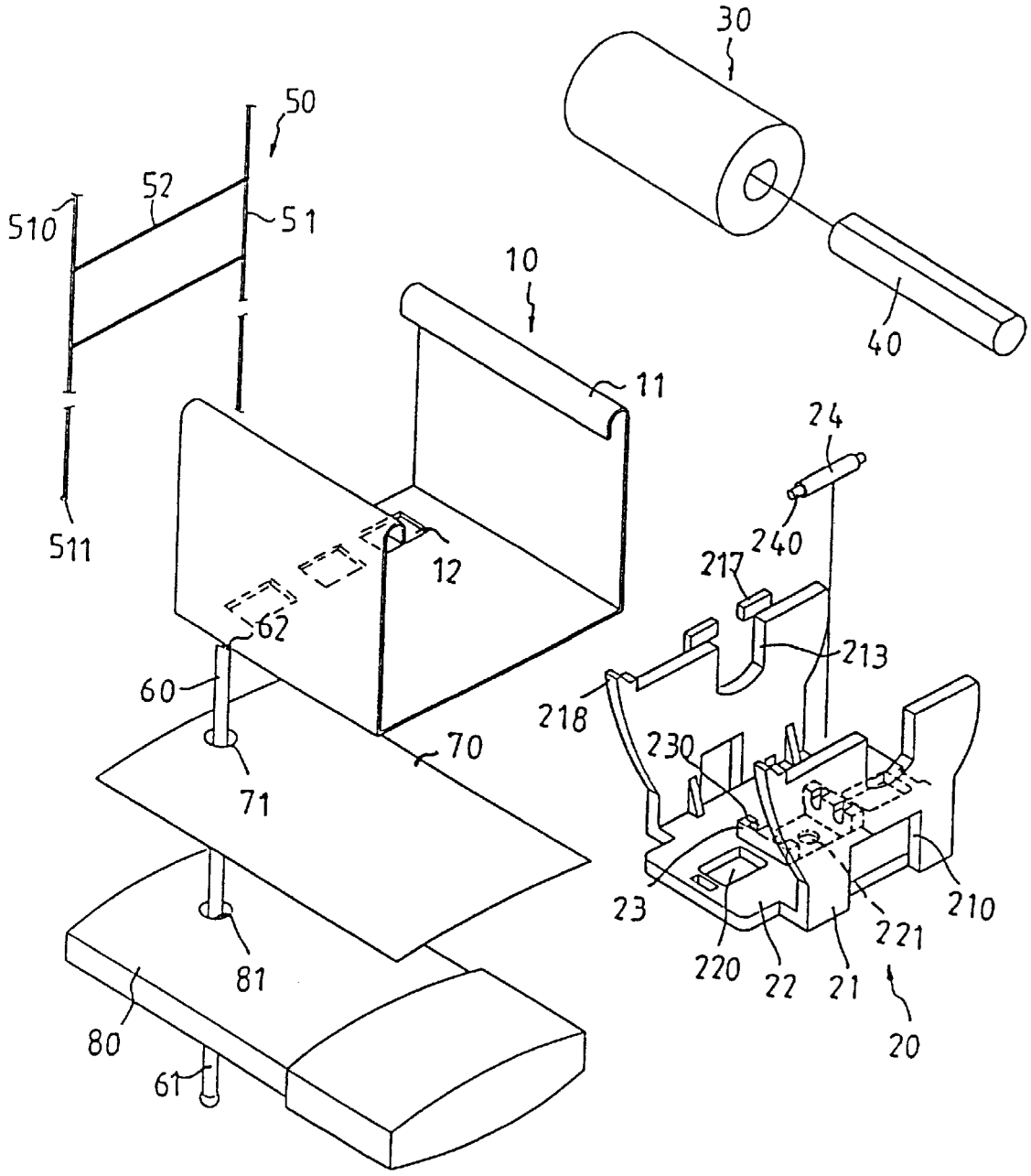
PRIOR ART FIG. 6
FIG. 6 is a perspective view of a conventional driving mechanism for a venetian blind.
Figure 7:
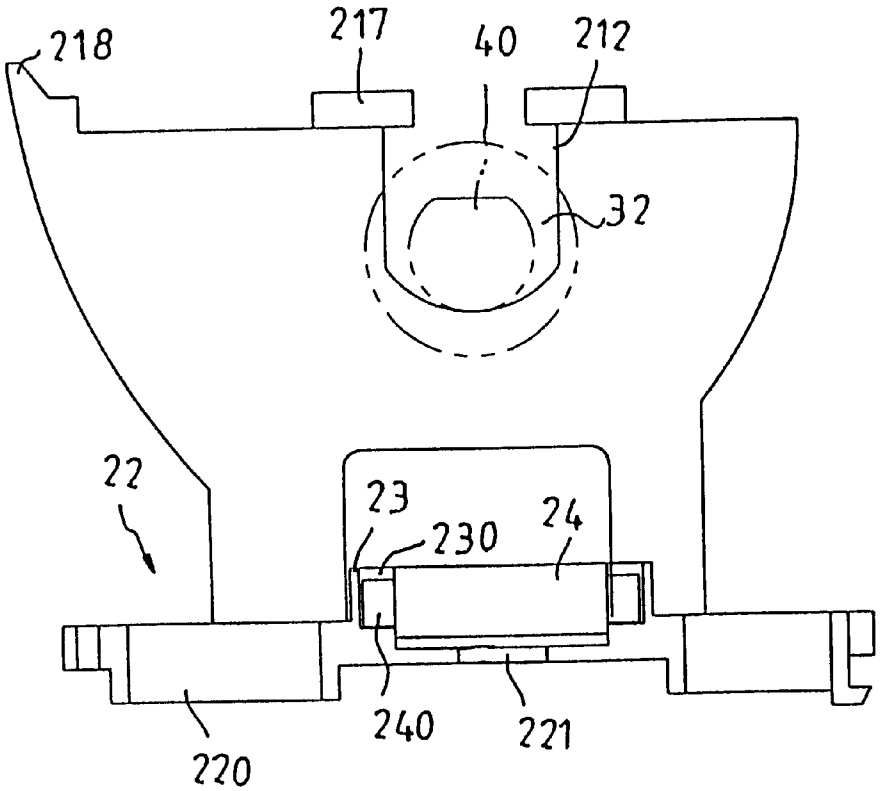
PRIOR ART FIG. 7
FIG. 7 is a sectional view of a conventional driving mechanism drive for a venetian blind.

Referring to FIGS. 1 to 5, the structure of a driving mechanism of the present invention is substantially similar to that of a conventional driving mechanism for a venetian blind. In accordance with the present invention, the driving mechanism has a frame body 10 having a fixing seat 20 being mounted thereto. The center region of the top section of the lateral walls 21 of the fixing seat 20 is pivotally mounted with a blind slat control element 20 driven by a control shaft 40. A pulling cord 50 is mounted to the blind slat control element 30 and is used to actuate respectively a main cord 51 of the pulling cord 50. The main cord 51 located at the lateral sides of the pulling cord 50 pass through a pulling cord hole 220 at the bottom section 22 of the fixing seat 20. A clipping cord 512 is provided in between the main cord 51, to hold a blind slat 70. A suspension cord 60 having one end passes through a suspension cord hole 221 at the bottom section 22 of the fixing seat 20. A bore 71 is provided to the blind slat 70 for the passage of the suspension cord 60. A base slat 80 is provided at the lower section of the blind slat 70 and is combined with the ends of the suspension cord 60 and the pulling cord 50 to form as a unit.

The fixing seat 20 is substantially a U-shaped structure having a first slot 210 and a second slot 211, located closely to the bottom section 22, at the two lateral side walls 21 thereof. The first slot 210 is for the passage of the suspension cord 60 and the second slot 211 is employed to reduce the material used. At the center of the top section of the two lateral side walls 21, a positioning slot 212 is provided, and at the bottom section 22 of the seat 20, the pulling cord hole 220 for the passage of the pulling cord and the suspension cord hole 221 for the passage of the suspension cord 60 are respectively provided. A shaft seat 23 is provided to the suspension hole 221, and a positioning slot 230 is used to pivotally fix a positioning end 240 at the two ends of a guide shaft 24.

The blind slat control element 30 is provided with a cord mounting slot 31 to mount a fixing section 510 located at the top section of the main cord 51. The center of the element 30 is provided with a through section 32 with polygonal shape for the passage of the control shaft 40. The characteristics of the present invention is that the rear terminal edge of the lateral side wall 21 of the fixing seat 20 is extended to connect with an one-piece reinforcement section 25 such that the fixing seat 20, the lateral side walls 21 and the bottom section 22 are integrally formed into a whole structure; at the lateral side wall 21 of the fixing seat 20, located closely to the bottom section 22 thereof, an elongated cord-fixing hole 213 is provided to facilitate the combination with and positioning of the fixing section 61 of the suspension cord 60; a cord-winding peg 82 is provided to the center of the hole 81 located at the base slat 80 for the passage of the suspension cord 60 so as to suspend the slat 80; the positioning slot 212 at the top section of the lateral wall 21 of the fixing seat 20 is semi-circular having a top opening end being formed into an opened guide slot 214, which is wider at the top thereof and is narrower at the bottom thereof, the guide slot 214 is formed together with the positioning slot 212 as a pointed blocking section 215, the external diameter end of the through section 32 of the blind slat control element 30 is correspondingly mounted with a cylindrical-shaped positioning section 33, which can thus engage with the blind slat control element 30 and the fixing seat 20, both of which are made of plastic material which avoiding friction formed as a result of the combination of metal and plastic material. Thus, the engagement and positioning effectiveness between the control element 30 and the fixing seat 20 are improved. The positioning section 33 of the control element 30 passes through the end section of the fixing seat 20 and extended to form an engaging section 330 such that the control element 30 is exactly positioned onto the fixing seat 20. The top section of the two lateral walls 21 of the fixings seat 20, corresponding to the engaging edge 11 of the main body 10, are provided with four groups of engaging ends 216, so as to obtain the effectiveness of the 4-points engagement positioning.

In accordance with the present invention, the following advantages are obtained:

(a) The combination of the fixing seat 20, the blind slat control element 30 and the control shaft 40 shall not cause a direct contact between the control shaft 40 and the fixing seat 20.

The control shaft 40 is contained within the blind slat control element 30 which does not produce friction with the fixing seat 20. Thus, damage to the fixing seat 20 caused by the rotation of the control shaft 40 is avoided. The longevity of the structure is thus improved.

(b) The effectiveness of positioning between the frame body 10 and the fixing seat 20 is greatly improved.

A plurality of engaging ends 216 of the fixing seat 20 being provided to engage with the engaging edge 11 of the frame body 10 has effectively improved the stability of engaged position of the fixing seat 20 and the frame body 10.

(c) The structure of the fixing seat 20 is strong.

The larger area and the greater height of the reinforcement section 25 combined with the two lateral side walls 21, and the bottom section 22 to form as a unit has largely improved the structure of the fixing seat 20. The supporting force at the bottom 22 is extended to the top section of the lateral walls 21 to avoid the deformation of the lateral walls 21.

(d) Force exerted to the suspension cord 60 by the base slat 80 and the blind slats 70 is smaller.

The fixing section 61 of the suspension cord 60 is fixed to the cord-fixing hole 213, and passes through the hole 71 of the blind slats 70 to the winding peg 82 located at the hole 81 of the base slat 80 and returns to the hole 71 of the blind slat 70, and to the suspension cord hole 221 of the fixing seat 20 to form a pulling section 62 for the user, such that the user uses only half of the pulling force to pull up the blind slats 70.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An improved structure of a driving mechanism for venetian blinds having a frame body and a fixing seat being mounted thereto, wherein the center region of the top section of the lateral walls of the fixing seat is pivotally mounted with a blind slat control element driven by a control shaft; a pulling cord is mounted to the blind slat control element and is used to actuate respectively a main cord of the pulling cord; the main cords located at the lateral sides of the pulling cord pass through a pulling cord hole at the bottom section of the fixing seat; a clipping cord is provided in between the main cords to hold a blind slat; a suspension cord having one end passes through a suspension cord hole at the bottom section of the fixing seat; a bore is provided to the blind slat for the passage of the suspension cord; and a base slat is provided at the lower section of the blind slat and is combined with the ends of the suspension cord and the pulling cord to form as a unit; a fixing seat is substantially a U-shaped structure having a first slot and a second slot, located closely to the bottom section, at the two lateral side walls thereof, the first slot is for the passage of the suspension cord and the second slot is employed to reduce the material used, at the center of the top section of the two lateral side walls, a positioning slot is provided, and at the bottom section of the seat, the pulling cord hole for the passage of the pulling cord and the suspension cord hole for the passage of the suspension cord are respectively provided; a shaft seat is provided to the suspension hole, and a positioning slot is used to pivotally fix a positioning end at the two ends of a guide shaft; a slat control element is provided with a cord mounting slot to mount a fixing section located at the top section of the main cord, and the center of the element is provided with a through section with polygonal shape for the passage of the control shaft, the driving mechanism is characterized in that the rear terminal edge of the lateral side wall of the fixing seat is extended to connect with an one-piece reinforcement section such that the fixing seat, the lateral side walls and the bottom section are integrally formed into a whole structure; at the lateral side wall of the fixing seat, located closely to the bottom section thereof, an elongated cord-fixing hole is provided to facilitate the combination with and positioning of the fixing section of the suspension cord; a cord-winding peg is provided to the center of the hole located at the base slat for the passage of the suspension cord so as to suspend the slat; the positioning slot at the top section of the lateral wall of the fixing seat is semi-circular shape having a top opening end being formed into an opened guide slot, which is wider at the top thereof and is narrower at the bottom thereof, the guide slot is formed together with the positioning slot as a pointed blocking section, the external diameter end of the through section of the blind slat control element is correspondingly mounted with a cylindrical-shaped positioning section, and the positioning section of the control element passes through the end section of the fixing seat and extended to form an engaging section such that the control element is exactly positioned onto the fixing seat; and the top section of the two lateral walls of the fixings seat, corresponding to the engaging edge of the main body, are provided with four groups of engaging ends, so as to obtain the effectiveness of the 4-points engagement positioning.

* * * * *